US005989128A

United States Patent [19]

Baker et al.

[11] Patent Number: 5,989,128

[45] Date of Patent: Nov. 23, 1999

[54] FLAME SIMULATION

[75] Inventors: Cindi L. Baker; Catherynne Ann Jean, both of Orlando, Fla.; Marilyn Lowey, Aspen, Colo.

[73] Assignee: Universal Studios, Inc., Universal City, Calif.

[21] Appl. No.: 09/004,527

[22] Filed: Jan. 8, 1998

[51] Int. Cl.[6] ..... A63J 5/02

[52] U.S. Cl. ..... 472/65; 472/75; 40/407

[58] Field of Search ..... 472/57, 65, 75, 472/81; 40/406, 407; 239/2.1, 14.1

[56] References Cited

U.S. PATENT DOCUMENTS

| | | | |
|---|---|---|---|
| 643,493 | 2/1900 | Fuller . | |
| 1,254,790 | 1/1918 | Fuller . | |
| 2,285,535 | 6/1942 | Schlett . | |
| 2,726,117 | 12/1955 | Barber . | |
| 3,069,794 | 12/1962 | Stalcup | 40/407 |
| 3,334,816 | 8/1967 | Mizuno . | |
| 3,432,439 | 3/1969 | Dickman | 472/65 |
| 3,711,698 | 1/1973 | Hess . | |
| 3,964,194 | 6/1976 | Gugeler . | |
| 3,978,598 | 9/1976 | Rose et al. | 472/65 X |
| 4,039,144 | 8/1977 | Mee | 239/2.1 |
| 4,303,397 | 12/1981 | Swiatosz | 472/65 X |
| 4,965,707 | 10/1990 | Butterfield | 472/65 X |
| 5,067,653 | 11/1991 | Araki et al. . | |
| 5,156,333 | 10/1992 | Worsfold | 472/65 X |
| 5,368,228 | 11/1994 | Adamson et al. . | |
| 5,445,322 | 8/1995 | Formhals et al. . | |
| 5,711,481 | 1/1998 | MacDonald et al. | 239/2.1 |

*Primary Examiner*—Kien T. Nguyen
*Attorney, Agent, or Firm*—Lyon & Lyon LLP

[57] ABSTRACT

The appearance of fire and flames is simulated using lighting, air pipes, fans, and fog manifolds. Water and air is sprayed into a display area to form a wall of mist which reflects light and light patterns. Air from the air pipes blows the wall of mist upwards. Fans generate a curtain of turbulent, upwardly flowing air that holds up the wall of mist, and makes it appear to flicker. Thematic lighting is projected onto the flickering wall of mist, to color the mist and simulate the flames.

26 Claims, 4 Drawing Sheets

FLAME SIMULATION

BACKGROUND OF THE INVENTION

The field of the invention is special or simulated visual and theatrical effects.

More specifically, the invention relates to the simulation of fire, flames and related visual effects.

Pyrotechnics are often used in displays and live performances to enhance the power of a presentation. However, real flames and smoke create hazards that may render the effect unsafe when performed close to the audience. In addition to requiring numerous costly controls and precautions, real fire effects burn fuel, releasing pollutants into the environment. When used indoors, real fire effects also require special air conditioning and ventilation. These requirements all add to the cost and complexity of designing, building, operating and maintaining a facility having real fire effects.

For the foregoing reasons, a realistic simulation of flames is desirable for effects which call for the illusion of fire and smoke. Simulation of fire is particularly useful in live displays, which occur with an audience at close range. Consequently, a fire effect is needed that may be performed safely without detracting from the realistic appearance of the flames.

SUMMARY OF THE INVENTION

The present invention produces an effect which satisfies the need for a realistic display of fire. The effect may be performed at a range of distances from an audience without reducing its visual impact or compromising the safety of the audience. In addition, the simulated effect is performed cleanly and efficiently.

To these ends vaporized water, compressed air, and air curtains advantageously create a wall of mist. Preferably an array of fog and compressed air pipes or manifolds are mounted on the floor of a display area. Each manifold most desirably has several nozzles spaced at intervals along its length. In a preferred embodiment, water is pumped at high pressure through the fog manifolds, spraying upwards through the nozzles to create a wall of mist in the display area. Compressed air is advantageously pumped at high pressure through the compressed air manifolds, flowing upwards out of the nozzles in thin streams into the wall of mist. The compressed air adds speed and power to the mist, driving it up. The wall of mist is most desirably shaped and made to flicker by an air curtain. The air curtain may be generated by fans mounted to the floor under or in front of the wall of mist or to a ceiling structure above the display area.

Thematic lighting may be projected on the flickering wall of mist to add the appropriate color and visual intensity to simulate a wall of flames, or other appearance. In the preferred embodiment, lighting having warm, bright color tones such as reds and yellows, make the mist appear to be a hot wall of fire and smoke. Lights having blue and other cool color tones may be used to make the mist appear cold, icy, or frosty. Light shaping patterns may also be used to alter the appearance of the simulated flames. For a hot wall of flames and smoke, a pattern that produces flame shapes which appear curvy may be projected onto the mist, whereas, a pattern for a cold flame may be shaped like a vertical slit, projecting an image of jagged, sharp ice formations.

BRIEF DESCRIPTION OF THE DRAWINGS

These and other features, aspects, and advantages of the invention will become better understood from the following description and accompanying drawings where.

DETAILED DESCRIPTION OF THE PREFERRED EMBODIMENT

Figure 1:
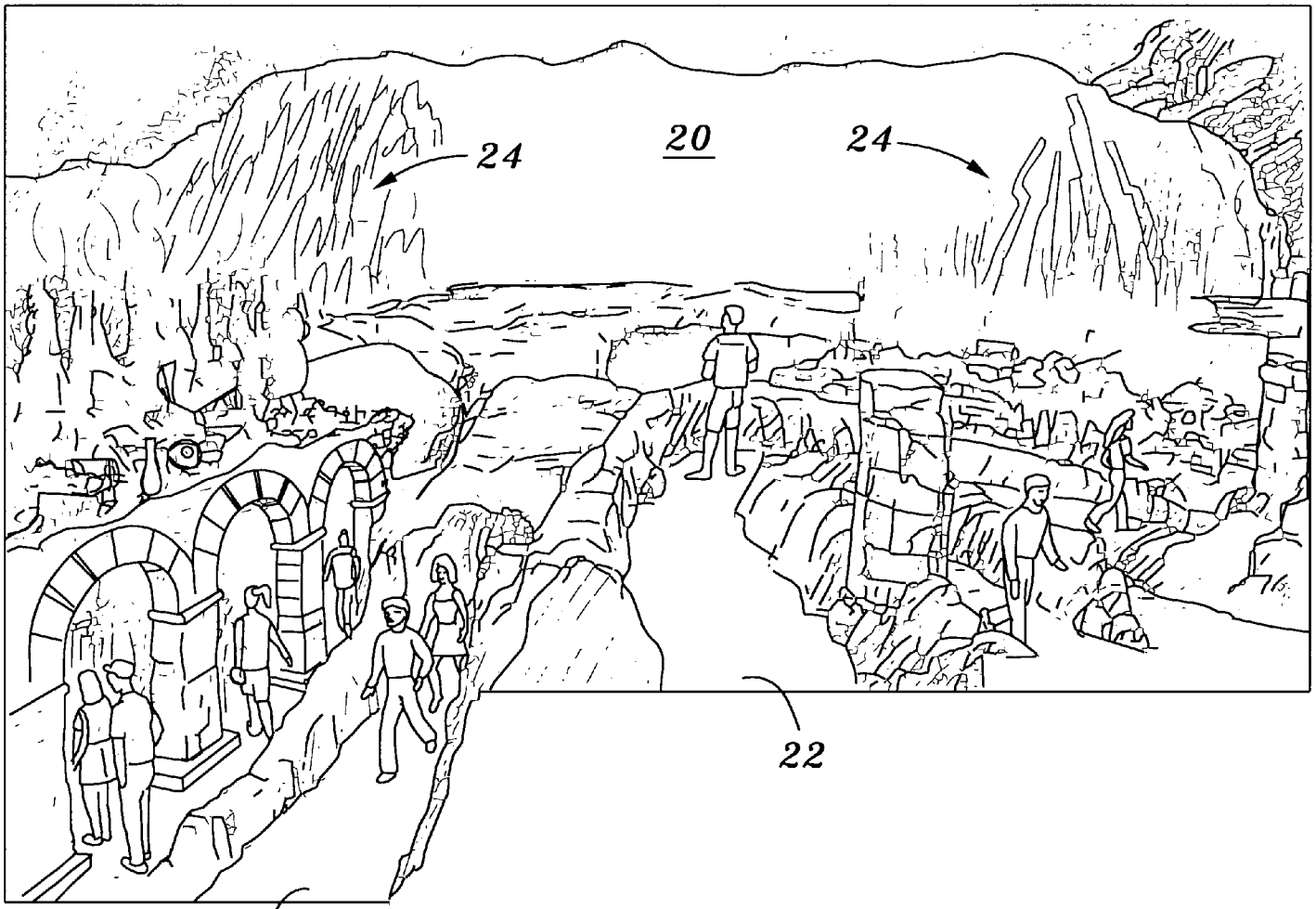
FIG. 1 is an overall perspective view of a display area and a wall of flames.

Turning now to the drawings, FIG. 1 shows a preferred embodiment of the invention as it may be used in a live performance, for example, in an amusement park. The effect created may be observed by an audience from a path or viewing area on the viewing side 22 of the display area 20. The wall of mist 24 is sprayed into the display area 20, while thematic lights are projected onto the mist to realistically simulate flames.

Figure 2:
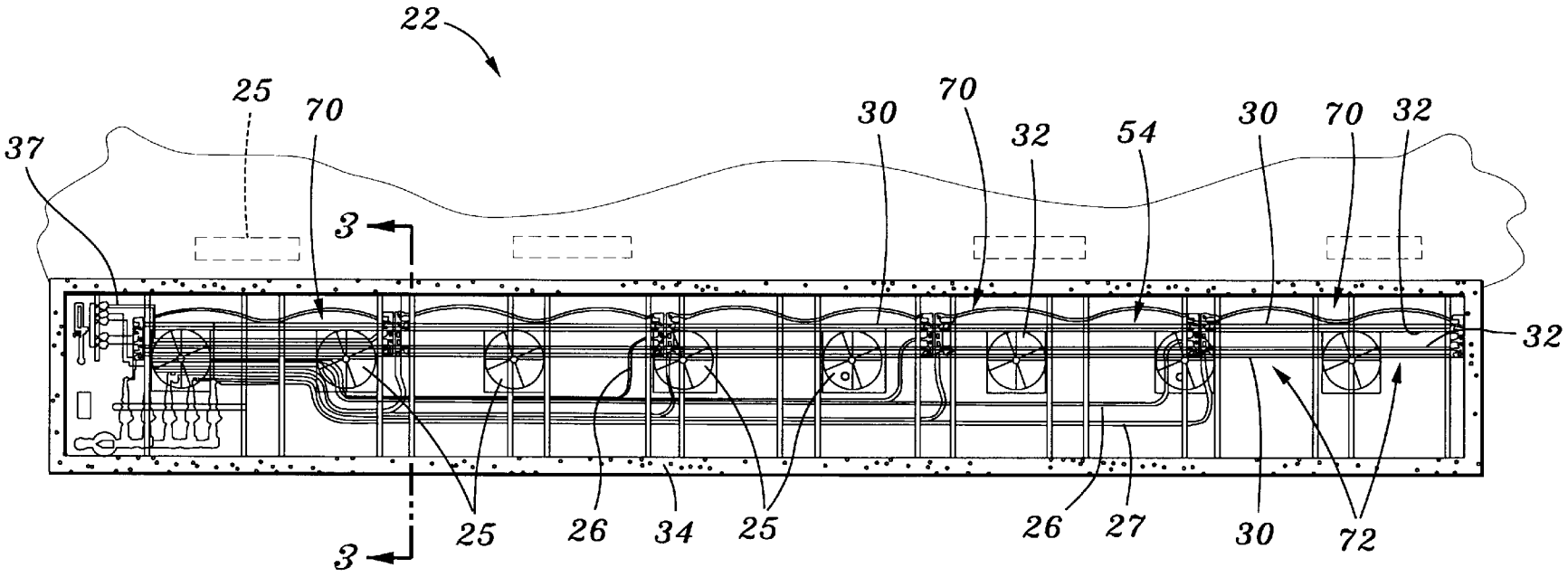
FIG. 2 is a plan view of a preferred embodiment of a base assembly and a ceiling assembly.
Figure 3:
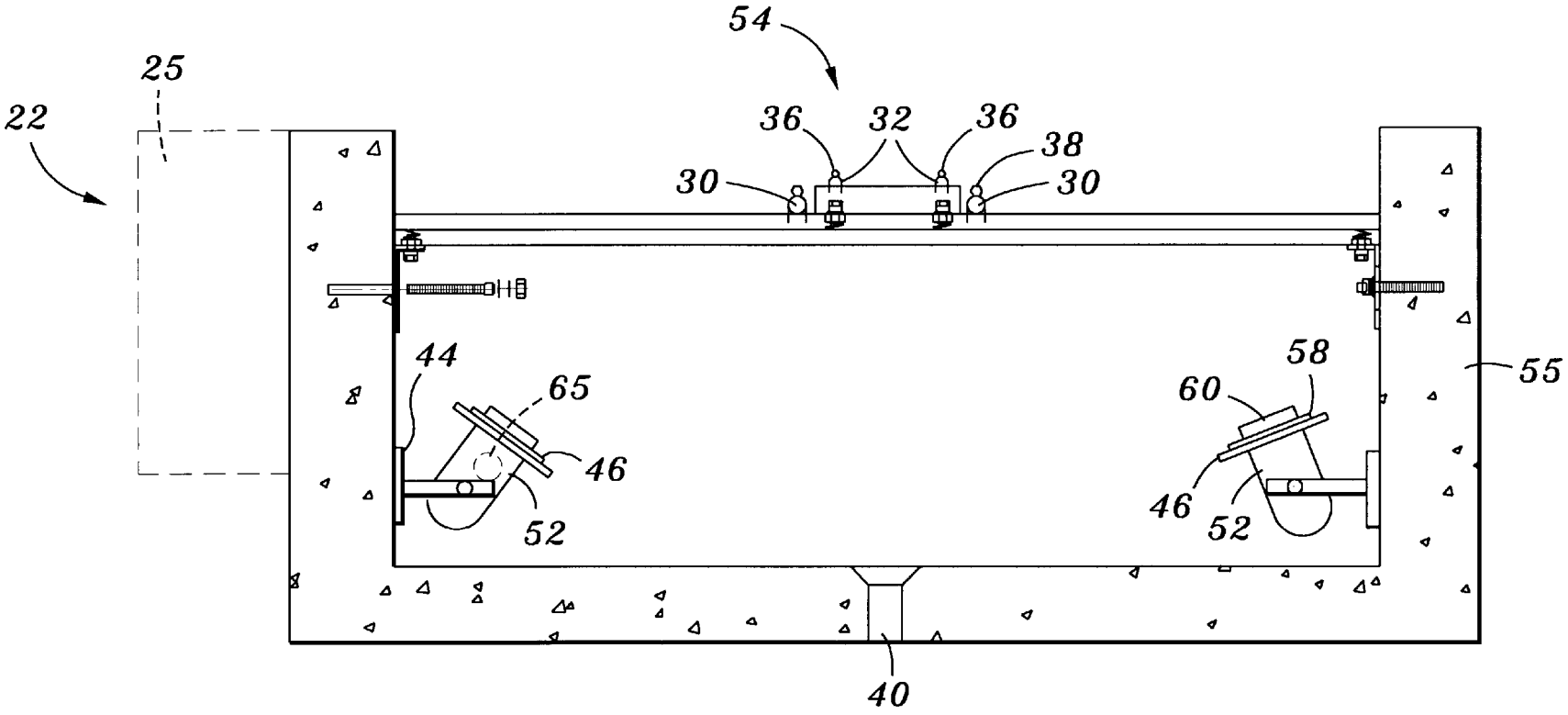
FIG. 3 is a sectional view taken substantially along the line 3—3 in FIG. 2.
Figure 4:
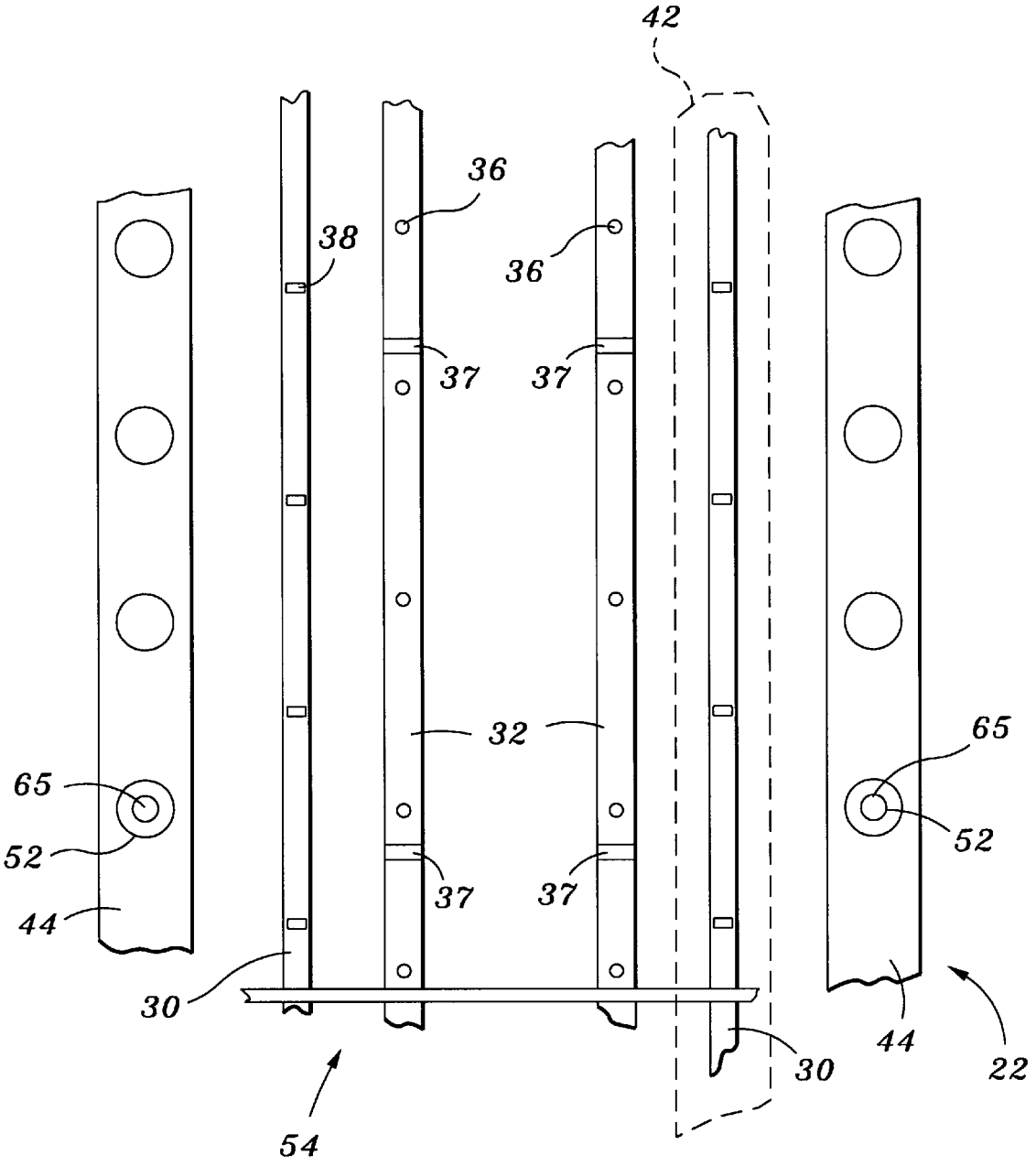
FIG. 4 is a schematic partial plan view of the base assembly and lighting rails.

As shown in FIGS. 2–4, in the preferred embodiment a manifold array 54 includes two fog manifolds 32 running parallel to and between two compressed air manifolds 30. Water is pumped into the fog manifolds 32 at high pressure, e.g., 1000 psi. Spray nozzles 36 are evenly spaced along the top surfaces of the fog manifolds 32 so that the water is sprayed upwardly from the nozzles to create a vertical wall of mist 24. The spacing between the spray nozzles is preferably about 6–12 inches.

Valves 37 control the flow of water to the spray nozzles 36. In the embodiment shown, the wall of mist 24 is about 40 feet long, and may reach a height of 15–18 feet. The fog and air manifolds 30 and 32 are spaced apart to give the wall of mist depth. The air manifolds 30 are positioned on both sides of the fog manifolds 32 to maintain a tall, vertical wall of mist that would otherwise collapse. The valves 37 may control the manifolds in zones causing the mist to burst from the nozzles 36 in series so as to create the illusion that the flames are chasing or propagating through the display area 20. The manifolds 30 and 32 accordingly, are in this embodiment divided into e.g., five chasing sections, with the valves 37 controlled in groups to allow the flame effect to chase or sequence from e.g., left to right. Alternatively, more valves may be used for more precise control, with each spray nozzle 36 having a separately controlled valve 37. In the embodiment shown, the nozzles 36 are grouped together with about 8–16 fog nozzles controlled by a single valve 37, with entire manifold array 54 having 5 chase sections, each about 8 feet long. As shown in FIG. 2, each chase section 70 is divided into two subsections 72 which are separately supplied with air and water via delivery lines 26 and 27.

Referring to FIG. 3, in the embodiment shown, the base structure 34 is made of concrete or the like, and forms a trough for collecting water. The manifold array 54 is attached to the vertical sides 55 of the trough, about 2 feet above the bottom surface of the base structure, to allow for lighting from below the manifold array 54. A drain 40 is located in the bottom of the trough. Air nozzles or openings 38 are spaced at intervals along the air manifolds 30. The air manifold may take various forms, including simply a pipe having spaced apart holes connected to a source of compressed air. Preferably air knifes available from Exair Corporation, Cincinnati, Ohio are used. The air knifes are preferably grouped together in zones, similar to the nozzles 36. Air knives direct the air vertically. In this embodiment each knife is about 30" long. Of course other means of directing air can also be used.

Referring to FIG. 2, exhaust fans or blowers 25 are mounted to the ceiling structure. The fans 25 generate an upwardly flowing air curtain of high volume/low pressure air on the viewing side 22 of the display. Alternatively, the exhaust fans may be mounted to the floor under the wall of mist. Each fan is nominally rated at 4500 CFM. The air curtain 42 draws up and shapes the wall of mist, and makes it flicker. Mist evacuation ducts 28 are also located on the ceiling structure, to remove mist that is drawn up from the display area 20. In an alternative design shown also in FIG. 2, the fans 25 may be located in front of the wall of mist, near ground level, in between the audience and the wall of mist. In this design, the fans are aimed upwardly and slightly towards the wall of mist.

As shown in FIG. 4 a lighting rail 44 contains spaced apart lighting fixtures 52. Each lighting fixture 52 includes a bulb 65 within a housing 53. A pair of lighting rails are supported in the base structure 34, below the manifold array 54. The lighting rail may be mounted to the floor, or walls, or to the manifolds. Colored gels 58 are placed in gel holders in the fixtures to make the wall of mist 24 appear either hot or cold. Red, yellow or other bright color gels 58 are used for a hot effect. Blue, purple, or other cooler color gels may be used for a cold effect, or to simulate blue natural gas flames.

Light shaping patterns or Gobos 46 are slidably positioned between the gel 58 and the lens 60 of the lighting fixture 52. The light shaping patterns 46 have openings 47 which shape the light so that flame shaped images are projected onto the wall of mist 24. Lenses 59 may be used to focus and direct the projected light. The patterns may be curvy to represent flame shapes, or they may be shaped like jagged vertical slits to create a cold, ice formation effect. The designs of the hot flame effect and the cold flame effect are the same except for the differences in lighting color and shaping patterns. In addition, in the preferred embodiment, for the cold wall of mist, the lighting fixtures are aligned in parallel lines on opposite sides of the manifold array, whereas for the hot wall of flames, the lights are laterally staggered rather than aligned in rows. The lighting fixtures are preferably concealed from the view of the audience.

The effect of the above described system of air and fog manifolds 32 and fans 25 is to create a shaped wall of mist 24 which reflects light and light patterns. The fog nozzles spray out a mist of vaporized water, which reflect light from the lighting fixtures. Preferably, the light is projected from the two lighting rails 44 which are located on both sides of the wall of mist. FIG. 4 shows the preferred location of the manifold array 54 between the lighting rails 44. The rails 44 preferably extend for the entire length of the manifold array 54.

The duration of the effect can be varied from intermittent to continuous. Preferably, the wall of mist is quickly created to a maximum height of about 18 feet, and then dropped down somewhat, by reducing the updraft created by the air curtain fans 25. The fans 25 create a turbulent flow of air which disrupts the stream of mist, creating a flickering or flamelike appearance. The valves, fans and lighting may be controlled by an electronic controller. The controller can be programmed to create different events.

FIG. 1 shows a preferred use of the invention. Guests walk on a path. The path leads to a loading station for a ride, such as a roller coaster. As they come to an overlook, a wall of simulated flame and smoke, created by the manifold array 54 and fans 25, bursts upwardly from the base structure positioned above the path. The flame and smoke effect chases from one side to the other, with each consecutive chasing section remaining on until the entire wall of mist is on. Then, after a timed interval, the wall of mist chases off or out in the same order (left to right from the guests point of view). The effect is preferably produced to a height of about 18 feet for about 15 seconds, (2 seconds chase in, 11 seconds at full size, 2 seconds chase out). The chasing movement across the 40 foot manifold array 54 is completed in about 2 seconds. The audience sees a flame effect. The flames appear turbulent, growing, and moving, generally randomly like real flames. Of course, the invention can also be used in other areas such as in theaters, displays, movies sets, etc.

Although the present invention has been described in detail with reference to the preferred embodiment, other embodiments are possible. Various substitutions and uses of equivalents may, of course, also be made. For example, the number and locations of fog and air manifolds, fans, nozzles, lights, etc. may be changed, within the scope of the invention. Other mediums may be substituted for water and air. The invention, therefore, should not be limited except by the following claims and their equivalents.

What is claimed is:

1. An apparatus for generating a special effect, comprising:

a fog manifold having a plurality of fog nozzles;

a liquid water source connected to the fog manifold;

a compressed gas manifold adjacent the fog manifold and having a plurality of gas nozzles; and a gas source connected to the gas manifold.

2. The apparatus of claim 1 wherein the fog nozzles are generally equally spaced apart.

3. The apparatus of claim 1 wherein the gas nozzles comprise air knives.

4. The apparatus of claim 1 further comprising a fan adjacent to the fog manifold.

5. The apparatus of claim 1 wherein the fog manifold is generally parallel to the air manifold.

6. An apparatus for generating a special effect comprising:

a fog manifold having a plurality of fog nozzles;

a compressed air manifold alongside the fog manifold and having a plurality of air nozzles;

a liquid water source connected to the fog manifold; and an air source connected to the air manifold.

7. An apparatus for generating a special effect comprising:

a fog manifold having a plurality of fog nozzles;

a compressed air manifold alongside the fog manifold and having a plurality of air nozzles;

a display area having a base structure and a ceiling structure; and the air manifold and the fog manifold mounted to said base structure with the fog nozzles and the air nozzles facing up.

8. An apparatus for simulating flames comprising:

a pair of elongate fog manifolds each having a plurality of spaced apart fog nozzles;

a pair of elongate compressed air manifolds having a plurality of spaced apart air nozzles, with the fog manifolds positioned to the inside of the air manifolds;

the air manifolds positioned so that air nozzles are aimed vertically upwardly; and a lighting strip having a plurality of spaced apart lighting fixtures, with the lighting strip positioned generally parallel to the fog and air manifolds.

9. The apparatus of claim 8 further comprising:

a display area having a base structure and a ceiling structure.

10. The apparatus of claim 9 further comprising:

an exhaust fan supported in the ceiling structure over at least one fog manifold.

11. The apparatus of claim 8 further comprising an exhaust fan supported on the base structure in between one of the air manifolds and an audience viewing area.

12. The apparatus of claim 8 further comprising a shaping pattern on said lighting fixtures.

13. The apparatus of claim 12 wherein the shaping pattern is flame shaped.

14. The apparatus of claim 12 wherein the shaping pattern comprises a plate having slit openings.

15. An amusement or theme park theater attraction comprising:

an audience viewing area; and a special effects area spaced apart from the audience viewing area, the special effects area having;

a plurality of mist nozzles spaced apart along the special effects area;

a water source connected to the mist nozzles;

a plurality of gas nozzles spaced apart along the special effects area;

a compressed gas source connected to the gas nozzles; and a fan positioned adjacent to the mist and gas nozzles, for drawing the mist upwardly.

16. The attraction of claim 15 further comprising a channel or trench containing the air and mist nozzles.

17. The attraction of claim 15 further comprising lighting fixtures positioned to project colored light above the mist and air nozzles.

18. The attraction of claim 15 wherein the fan is positioned above the air and mist nozzles.

19. The attraction of claim 15 wherein the fan is positioned between audience viewing area and the special effects area.

20. The attraction of claim 15 further comprising a gas pipe connecting the source of compressed gas to the gas nozzles, with the gas nozzles mounted on the gas pipe, and a mist pipe connecting the mist nozzles to the water source, and with the mist nozzles mounted on the mist pipe.

21. A method for simulating visual and theatrical effects comprising the steps of:

pumping liquid water through a fog manifold having a plurality of fog nozzles to produce a wall of mist; and pumping compressed air through a plurality of air nozzles in a compressed air manifold, and into the wall of mist, with the compressed air manifold positioned alongside the fog manifold.

22. The method for simulating visual and theatrical effects of claim 21, wherein the fog nozzles and the air nozzles point generally upward.

23. The method for simulating visual and theatrical effects of claim 21 further comprising the step of:

projecting lighting on the wall of mist.

24. An apparatus for generating a special effect, comprising:

a fog manifold having a plurality of spaced apart fog nozzles;

a compressed air manifold adjacent the fog manifold and having a plurality of spaced apart air nozzles; and a compressed air source connected to the air manifold.

25. The apparatus of claim 24 wherein the fog nozzles and air nozzles are spaced apart in linear arrays.

26. An apparatus for generating a special effect comprising:

a fog manifold having a plurality of fog nozzles aimed vertically upwardly;

a compressed gas manifold adjacent to the fog manifold and having a plurality of gas nozzles aimed vertically upwardly;

a fog media source connected to the fog manifold; and a compressed gas source connected to the compressed gas manifold.

* * * * *